US012655745B2

(12) United States Patent
Song et al.

(10) Patent No.: US 12,655,745 B2
(45) Date of Patent: Jun. 16, 2026

(54) PREDICTION BASED PUMP-OFF DETECTION

(71) Applicant: Halliburton Energy Services, Inc., Houston, TX (US)

(72) Inventors: Siyang Song, Humble, TX (US); Atchyuta Ramayya Venna, Houston, TX (US); Jian Wu, Houston, TX (US); Robert P. Darbe, Tomball, TX (US); Sudhir Kumar Gupta, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1155 days.

(21) Appl. No.: 17/643,027

(22) Filed: Dec. 7, 2021

(65) Prior Publication Data

US 2023/0175388 A1 Jun. 8, 2023

(51) Int. Cl.

| | |
|---|---|
| ***E21B 47/008*** | (2012.01) |
| ***E21B 47/12*** | (2012.01) |
| ***F04B 49/06*** | (2006.01) |

(52) U.S. Cl.

CPC ..... *E21B 47/008* (2020.05); *E21B 47/12* (2013.01); *F04B 49/065* (2013.01); *E21B 2200/20* (2020.05)

(58) Field of Classification Search

CPC .... E21B 47/008; E21B 47/12; E21B 2200/20; F04B 49/065

See application file for complete search history.

(56) References Cited

U.S. PATENT DOCUMENTS

| | | | | |
|---|---|---|---|---|
| 4,363,605 | A | 12/1982 | Mills | |
| 9,109,415 | B2 | 8/2015 | Coles | |
| 9,617,814 | B2 | 4/2017 | Seals et al. | |
| 9,657,540 | B2 | 5/2017 | Coles et al. | |
| 10,309,176 | B2 | 6/2019 | Allmaras et al. | |
| 10,400,536 | B2 * | 9/2019 | Seshadri | E21B 23/08 |
| 10,435,973 | B2 | 10/2019 | Viassolo et al. | |
| 2016/0076325 | A1 | 3/2016 | Dykstra et al. | |
| 2017/0145810 | A1 | 5/2017 | Deghuee et al. | |
| 2017/0241221 | A1 | 8/2017 | Seshadri et al. | |
| 2017/0314353 | A1 * | 11/2017 | Viassolo | E21B 23/14 |
| 2020/0270979 | A1 | 8/2020 | Hradecky et al. | |
| 2021/0262303 | A1 | 8/2021 | Venna et al. | |

OTHER PUBLICATIONS

"PCT Application No. PCT/US2021/072796, International Search Report and Written Opinion", Aug. 26, 2022, 9 pages.

"AU Application No. 2021477258, Second Examination Report", Apr. 10, 2025, 6 pages.

* cited by examiner

*Primary Examiner* — Rehana Perveen
*Assistant Examiner* — Angel Calle
(74) *Attorney, Agent, or Firm* — DeLizio, Peacock, Lewin & Guerra LLP

(57) ABSTRACT

Pump-off detection, and actions to avert a pump-off event from occurring, are described that may be implemented in a wireline control system while performing a pump-down operation to position a downhole tool within a wellbore. As part of the pump-down operation, the downhole tool is attached to a wireline coupling the tool to a wireline control device located at the surface above the wellbore.

21 Claims, 7 Drawing Sheets

PREDICTION BASED PUMP-OFF DETECTION

TECHNICAL FIELD

The present disclosure relates to oilfield operations generally, and more specifically to conveying a tool in a wellbore.

BACKGROUND

Pump-down operations are performed to convey wireline tools to a desired depth in a wellbore, including horizontally oriented portions of the wellbore. A typical setup includes a wireline unit (usually a winch), and a pump unit. While the pump-down fluid (water or mud) is pumped down into the wellbore to push the tool, the wireline is released at a controlled rate to maintain the tension on the wireline within a desired range. In pump-down operations, the downhole tension on the wireline may increase due to unexpected downhole environmental change, and/or inappropriate operations, etc. The increased tension may damage the wireline, or even worse, causes a lost-in-hole liability wherein the tool becomes separated from the wireline. During the pump-off, a tension spike usually happens in a very short period (in few seconds). Therefore, once the pump-off event begins to occur, it is difficult to take action(s) in time to avert the actual pump-off from occurring.

BRIEF DESCRIPTION OF THE DRAWINGS

Embodiments of the disclosure may be better understood by referencing the accompanying drawings.

Figure 1:
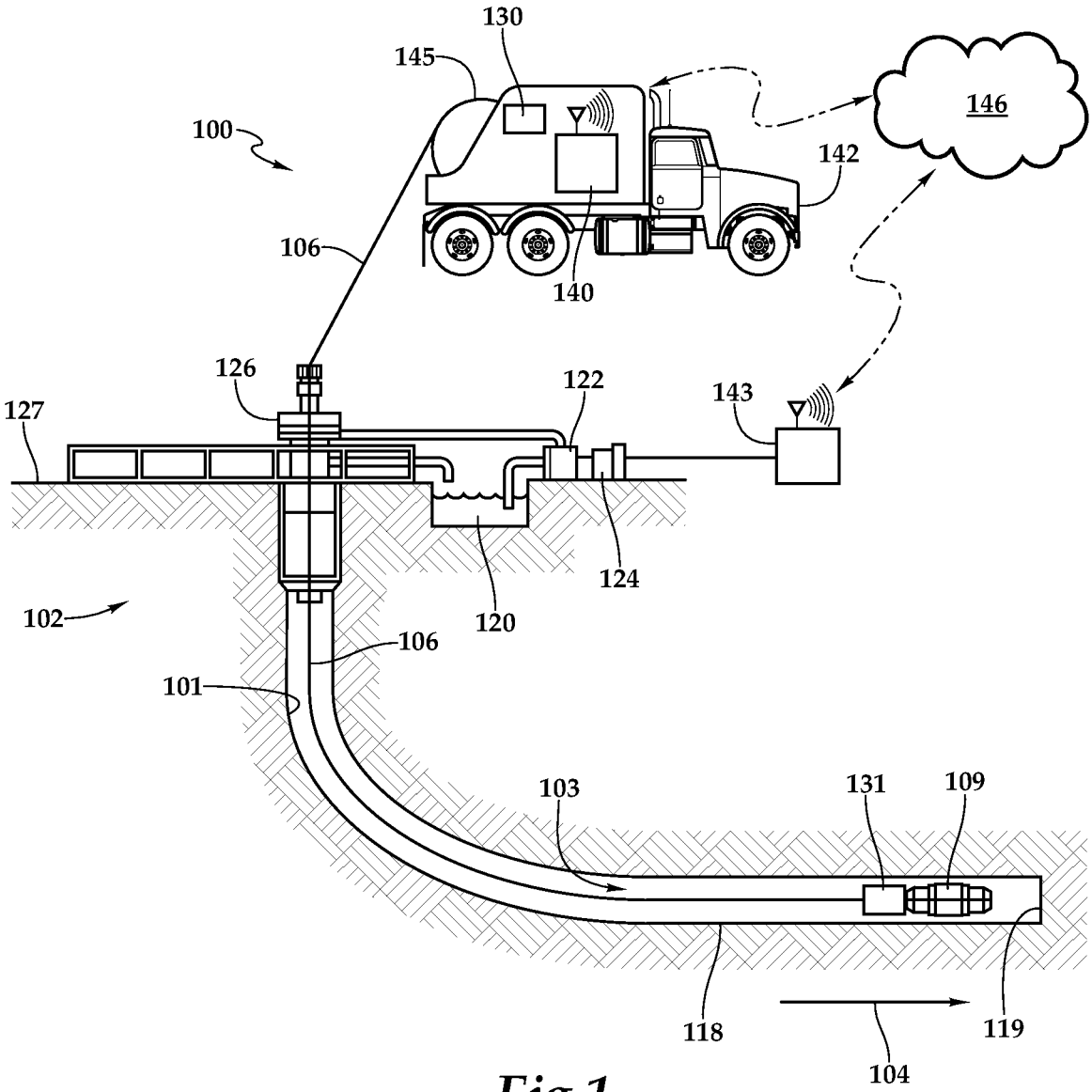
FIG. 1 is a cross-sectional side view of a system configured to perform pump-down operations to position a tool within a wellbore, according to various embodiments.

The drawings are provided for the purpose of illustrating example embodiments. The scope of the claims and of the disclosure is not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown exaggerated in scale or in somewhat schematic form, and some details of conventional elements may not be shown in the interest of clarity and conciseness.

DETAILED DESCRIPTION

The description that follows includes example systems, methods, techniques, and program flows that embody embodiments of the disclosure. However, it is understood that this disclosure may be practiced without these specific details. In other instances, well-known instruction instances, protocols, structures and techniques have not been shown in detail in order not to obfuscate the description.

Certain aspects and examples of the present disclosure relate to a method to automate the pump-down operation by simultaneously controlling wireline speed and pump rate under closed-loop control to achieve target downhole wireline cable tension and recommended job speed. Wireline tools may be conveyed down a wellbore using hydraulic pressure to move the tool, particularly in inclined and horizontal sections of the wellbore. The hydraulic pressure and the wireline speed should be balanced to permit the tool to be conveyed down the wellbore at a highest safe speed. Imbalances between the hydraulic pressure in the wireline speed can lead to a condition known as pump-off, where the tool separates from the wireline cable. Recovery of the tool after pump-off can be an expensive and time-consuming process. In order to convey a wireline tool down a wellbore at a highest safe speed while avoiding pump-off, aspects of the present disclosure can provide pump-off prediction of the occurrence of a pump-off event at some time in the future, and thus allow various actions to be taken in order to avert an actual pump-off event from occurring.

During a pump-down operation, tension may increase in the wireline cable to an extent that the cable is damaged or completely severed (e.g., at a weak point where the cable attaches to the tool), a condition known as pump-off. Pump-off requires expensive and time-consuming remediation. Effective and efficient pump-down operations avoid pump-off and allow the tool placement operation, (e.g., pump-down operation), to be completed in less time. Avoiding pump-off can save money and reduce nonproductive time. Further, running the job with recommended speed can reduce water needed for pump-down, and save drilling mud and pump-down operation time. Automating the pump-down operation and the use of the pump-off predictions as described in this disclosure can reduce the need for manual intervention by field operators, as well as reduce human errors.

Apparatuses and methods according to the present disclosure may increase the reliability of the current pump-down systems by decreasing the risk of wireline damage and/or lost-in-hole liability. With a more reliable pump-down system, the non-production time and cost of the operation can be reduced, the potential loss due to support line damage and tool phishing can be reduced. Secondly, the implementation of the proposed predictor and controller requires fewer measurements than the existing technology. Thus, less cost in the implementation of the proposed solution can be expected.

Embodiments of the proposed systems, methods, and techniques as described in this disclosure have been validated using field data. The detection of the pump-off can be fast (in some examples less than 1 second). The sensitivity of the detector has been validated using the field data to make sure false alarms are not triggered. FIG. 1 is a cross-sectional side view of a system 100 configured to perform pump-down operations to position a tool within a wellbore, according to various embodiments. Referring to FIG. 1, a wellbore 118 may be formed by drilling into the earth through formation material 102. After creation of the wellbore 118, various operations may be performed downhole within the wellbore using wireline tools. A wireline tool 109, for example a logging tool, a perforating gun, packer, or other downhole completion or production components, may be positioned or otherwise arranged on a wireline cable 106, also referred to as "wireline 106," which extends into the wellbore 118 from the surface 127, and may be conveyed downhole while coupled to the tool 109 positioned within the wellbore. A pumping fluid located in a fluid reservoir 120 may be drawn from the fluid reservoir and pumped downhole using a hydraulic pump 122 powered by an adjacent power source, such as a prime mover or motor 124, to convey the pumping fluid to a wellhead 126. Wellhead 126 is configured to provide a seal over the top of the wellbore 118 at the surface 127 of the formation material 102. Wellhead 126 is further configured to provide a fluid passageway to allow the pumping fluid provided to the wellhead from pump 122 to pass through the wellhead and be provided to an interior space 103 within the wellbore 118 that extends from the wellhead through the wellbore to the tool 109 position within the wellbore.

Fluid pressure developed within interior space 103 is exerted against the uphole surface(s) of tool 109, thereby urging tool 109 to move within the wellbore 118 in a direction away from surface 127 and toward a terminus 119 of the wellbore, for example in a direction generally indicated by arrow 104. As shown in FIG. 1, system 100 may be used to traverse tool 109 through a portion of wellbore 118 having a generally horizontal orientation relative to surface 127. However, embodiments of system 100 are not limited to moving tool 109 through one or more portions of a wellbore having a particular orientation, or a same orientation relative to one another, and may be configured to move tool 109 through a portion or portions of wellbore having vertical, inclined, and/or horizontal orientations, and/or a combination of different orientations. In various embodiments, tool 109 may incorporate outer dimensions and/or an outer seal mechanism that form a fluid seal between the tool 109 and an interior surface 101 of the wellbore 118 to aid in maintaining the fluid pressure and a rate of fluid flow within interior space 103, and thus provide force on the uphole surface(s) of tool 109 in order to urge the tool in the downhole direction. The wireline 106, which is physically coupled to the tool 109, and which extend to a mechanism, such as winch 145 as illustrated in FIG. 1, is configured to provide a force on tool 109 that is opposed to the downhole force being applied to tool 109 by the fluid pressure present within interior space 103. By controlling the rate at which wireline 106 is extended into the wellbore 118, for example through the control of winch 145, a tension is generated in wireline 106, and thereby controlling the rate at which the tool 109 proceeds downhole through the wellbore 118, in conjunction with control over the fluid pressure and/or fluid flow rate provided to interior space 103 from fluid provided by pump 122. By controllably providing the fluid pressure and the fluid flow rate to interior space 103, in conjunction with operating winch 145 to provide additional wireline 106 to the wellbore 118 at a controlled rate, a tension created on wireline 106 is used to provide controlled movement of tool 109 within the wellbore. Although a winch 145 is illustrated in FIG. 1, the control of the wireline into wellbore 118 is not limited to use of a winch, and any other device, apparatus, or mechanism that can be configured to controllably provide the wireline 106 to the wellhead and to the wellbore may be used in embodiments of system 100.

Depending on various factors, wireline 106 is configured to withstand a range of tensions along its length, in various embodiments up to a maximum tension value. If the maximum tension value is exceeded, the wireline may break, thus breaking the physical connection between tool 109 and the winch mechanism 145, and thus also losing the ability to controllably lower the tool 109 into the wellbore and/or to retrieve the tool from the wellbore using the wireline. In various embodiments, a coupling mechanism used to secure the physical coupling between the wireline 106 and the tool 109 may also be rated to withstand a pulling force having a maximum rating. If this maximum rating is exceeded, the coupling mechanism may fail, for example by breaking apart, and thus allowing wireline 106 to become disconnected from tool 109. These scenarios wherein the tool 109 is no longer physically coupled to the wireline 106 may be referred to as a "pump-off event," and is an adverse condition that is to be avoided as part of a pump-down operation.

In order to control the positioning of the tool 109 within wellbore 118, and in order to avoid a pump-off event from occurring, system 100 may employ the apparatus, methods, and techniques as described herein. In various embodiments, a level of tension present on the wireline 106 may be monitored by one or more sensors. In FIG. 1, embodiments of system 100 may include a tension sensor 130 positioned at or near the winch mechanism 145, and configured to sense a level of tension present on wireline 106. Embodiments of system 100 may include a tension senor 131 positioned on or adjacent to the tool, such as tool 109, wherein tension senor 131 is configured to measure a level of tension present on wireline 106. Sensors 130, 131 are not limited to any particular type of sensor, and may comprise any type of sensor configured to measure a level of tension on wireline 106, and to provide an output signal indicative of the measured level of tension. In various embodiments, sensors 130, 131 may include strain gauge sensors, piezoelectric sensors, and/or hydraulic/pneumatic load cells, etc. The number and/or the location of sensor(s) configured to sense the tension present on wireline 106 is not limited to one or two sensors, and may include a number of sensors, which may be located at any position within system 100 that allows for the sensors to measure the level of tension present on wireline 106.

The tension sensor(s) included in system 100 may provide an output signal, such as an electrical or optical signal, which is representative of the real-time tension level present on the wireline 106. These output signal(s) may be communicatively coupled, for example through a wired connection and/or wirelessly, to a computing device, such as computing device 140, which may be positioned above surface 127, and for example may be provided as part of a mobile vehicle 142 that also provides and controls the operation of winch 145. In alternative embodiments, computing device 140 may be permanently installed with the system 100, may be handheld, or may be remotely located. In embodiments of system 100 where more than one sensor is utilized, the output from one sensor may be used as a redundant signal to confirm the proper operation of a primary sensor. In the alternative, when multiple sensors are utilized in system 100, the sensed outputs from the sensors may be averaged or otherwise processed to determine an adjusted tension level present on wireline 106.

In addition to or in an alternative embodiment, these output signal(s) provided by one or more tension sensors, such as sensors 130, 131, may be communicatively coupled, for example thorough a wired connection and/or wirelessly, to a computing device, such as computing device 143, which may be positioned above surface 127, and for example may be provided as part of a control system configured to control the operation of pump 122 and motor 124. In various embodiments, computing device 143 is configured to provide control instructions and/or output signals that control the operation of motor 124, which in turn controls pump 122 providing the fluid pressure at a controller fluid flow rate to interior space 103 within the wellbore 118. Control over motor 124, and thus control over pump 122, is configured to control the fluid pressure and/or the fluid flow rate at which the drilling fluid being used to move tool 109 along through wellbore 118 is being provided to interior space 103, and thus has an effect on the tension generated in wireline 106 during a pump-down operation.

In embodiments of system 100 that include multiple computing devices, the computing devices may be communicatively coupled through a network 146, which may include wired connections, wireless connections, and/or a combination of wired and wireless connections, which allow data and/or instructions to be electronically communicated between the computing devices. For example, in various embodiments of system 100 one of computing devices 140 or 143 also configured to monitor the tension present in wireline 106 during a pump-down operation, and to provide a prediction of a pump-off event that is predicted to happen at a future time based on the real-time tension measurement signals received from one or more of sensor 130, 131. In alternative embodiments, the pump and the winch may be controlled by a single computer device configured to send commands to both the pump controller and to the winch controller. As further described below, a predictor included in one of computing devices 140 or 143 is configured to receive the output signals from one or more of sensors 130, 131, the output signals indicative of the real-time tension present on wireline 106, and to provide a prediction of a pump-off event that is predicted to happen at some future time during the pump-down operation. Based in the prediction of a pump-off event occurring at some future time, the computing device 140 or 143 is further configured to activate a pump-off controller. The pump-off controller, when activated, may perform a variety of functions that are intended to react to the prediction of a pump-off event, and in various embodiments to take actions that are intended to avert the pump-off event from actually occurring.

In various embodiments, activation of the pump-off controller may include the pump-off controller terminating the pump-down operation that is currently underway. As part of the termination of the pump-down operation, the pump-off controller may take over control of the operation of winch 145, and increase the rate that the wireline 106 is being provided to the wellbore from the winch, in some examples up to a maximum operating speed that the winch is configured to operate to provide an output of wireline to the wellbore. In addition to or in the alternative to taking over control of the winch, in various embodiments the pump-off controller is configured to take over control of motor 124, and thus control pump 122, as part of the termination of the pump-down operation. In various embodiments, the pump-off controller may reduce or stop altogether the pumping of fluid to the wellbore 118 being provided by motor 124/pump 122, thus reducing and/or eliminating additional pumping fluid and/or pressure provided by the fluid within interior space 103 of the wellbore. The reduction/elimination of the pumping fluid flow and/or pressure may reduce and/or eliminate the forces exerted on the uphole surface(s) of tool 109, and thus reduce and/or eliminate the tension on wireline 106 being asserted by the fluid pressure forces and the controlled fluid flow rate imposed on tool 109. The reduction/elimination of the tension of wireline 106 is intended to avert the actual pump-off event from occurring within system 100.

In various embodiments, system 100 includes a computing device, for example computing device 140, that is configured to provide control over both the pump-down operations under normal conditions, and to provide the predictor configured to monitor tension levels in wireline 106 provided by signals from one or more sensors 130, 131, and to predict a pump-off event, including activating the pump-off controller when a pump-off event is predicted to occur. Computing device 140 may also be configured to take over control of the winch 145 and/or motor 124/pump 122 as part of activation of the pump-off controller in order to avert the actual occurrence of a pump-off event within system 100. In alternative embodiment, computer device 140 is configured to directly control the winch 145 and to provide output instructions that are communicated to computing device 143 to control the operations of motor 124/pump 122, both during normal pump-down operations and/or after activation of the pump-off controller. Other variations on the actual functions provided by the respective computing devices included in system 100 are possible and are contemplated as alternative embodiments that may be used to implement system 100.

In various embodiments, communications and transfer of data and instructions between different computing devices, such as computing devices 140 and 143, may be provided at least in part using wireless connections, and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communications between computing devices may use acoustic waves, surface waves, vibrations, optical waves, or induction (e.g., magnetic induction) for engaging in wireless communications. In other examples, the communication between computing devices may be wired connections, and can include interfaces such as Ethernet, USB, IEEE 1394, or a fiber optic interface. The computing devices 140 and 143 may receive wired or wireless communications from one another, and communication with other devices included in system 100, such as winch 145 and pump motor 124, in order to perform one or more tasks based on these communications. Methods and systems of the present disclosure may be applied in all phases of hydrocarbon production (e.g., well drilling, well completion, recovery and production).

Figure 2:
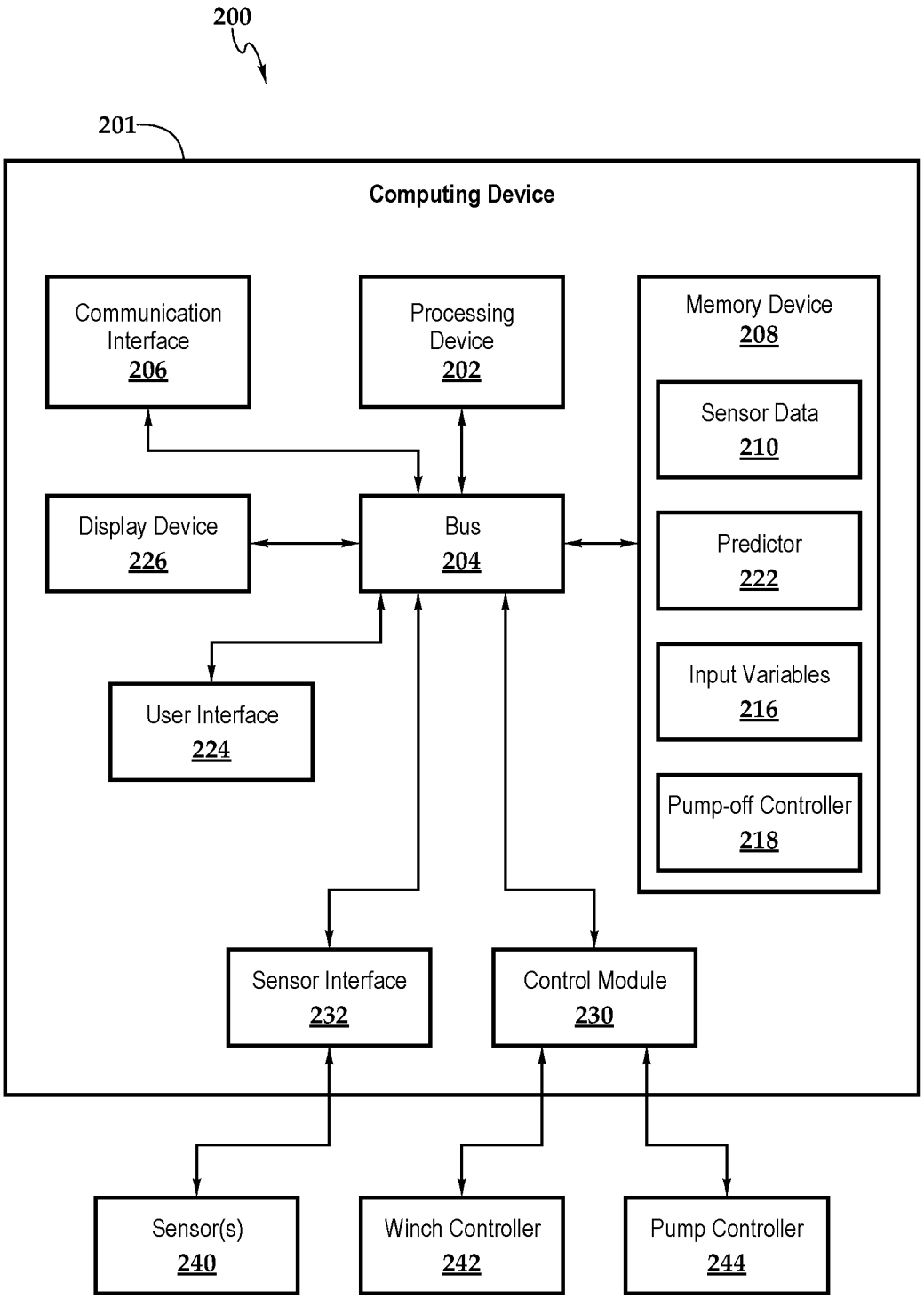
FIG. 2 is a block diagram of a computing device, according to various embodiments.

FIG. 2 is a block diagram of a computing system 200 including computing device 201, according to various embodiments. In various embodiments, computing device 201 is an embodiment of one or both of the computing devices 140, 143 of FIG. 1. Referring back to FIG. 2, embodiments of computing system 200 include a processing device 202, a communication interface 206, a memory device 208, a user interface device 224, a display device 226, a control module 230, and a sensor interface 232. As shown in FIG. 2, these components of computing device 201 may be communicatively coupled together using bus 204. Bus 204 is not limited to any particular bus structure or limited to configurations using any particular communication protocol, and may incorporate multiple types of bus structures using different communication protocols. In some embodiments, some or all of the components shown in FIG.

2 can be integrated into a single structure, such as a single housing. In various embodiments, some or all of the components shown in FIG. 2 may be distributed (e.g., in separate housings) and are in communication with each other.

The processing device 202 can execute instructions stored in the memory device 208 to perform the pump-down operations and/or to perform prediction of a pump-off event, and/or perform various function related to the activation of a pump-off controller 218. Embodiments of processing device 202 may include one processing device or multiple processing devices. Non-limiting examples of the processing device 202 include a Field-Programmable Gate Array ("FPGA"), an application-specific integrated circuit ("ASIC"), a micro-processing device, etc.

The processing device 202 may be communicatively coupled to the memory device 208 via the bus 204. Non-volatile embodiments of memory device 208 may include any type of memory device that retains stored information when powered off. Non-limiting examples of the memory device 208 include electrically erasable and programmable read-only memory ("EEPROM"), flash memory, or any other type of non-volatile memory. In some examples, at least some of the memory device 208 may include a non-transitory medium from which the processing device 202 can read instructions. A computer-readable medium can include electronic, optical, magnetic, or other storage devices capable of providing the processing device 202 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

In some examples, the memory device 208 can include data 210, which may include instructions for operations to be performed by processing device 202, and other data. The memory device 208 can also include a database of input variables 216, such as values for threshold limits, mud weight, inclination of the wellbore, bending moment, as well as constraints such as kinematics constraints, and safety constraints. Memory device 208 further includes predictor 222 and pump-off controller 218. Embodiments of predictor 222 include application(s) that may be executed by processing device 202 in order to provide a prediction of the occurrence of a pump-off event, as further described below. Embodiments of pump-off controller 218 include application(s) that may be executed by processing device 202 in order to react to the prediction, made by predictor 222, that a pump-off event is predicted, wherein the pump-off controller 218 includes instructions for actions to be taken by one or more devices in the system performing the pump-down operations that are intended to avert the actual occurrence of the pump-off event.

In some embodiments, the computing device 201 includes a communication interface 206. The communication interface 206 can represent one or more components that facilitate a network connection or otherwise facilitate communication between electronic devices (not shown in FIG. 2) that are external to computing device 201. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or other mobile communications network). In some embodiments, the computing device 201 can include a user interface device 224. The user interface device 224 may include one or more components, such as a computer keyboard, computer mouse, and/or a touch screen, which allow a user, such as a technician, to input data and/or programming into computing device 201. In some embodiments, the computing device 201 includes a display device 226. The display device 226 may include one or more components used to display graphical information, which may include data. Examples of the display device 226 include a liquid-crystal display (LCD), a computer monitor, a touch-screen display, etc. In some embodiments, the user interface device 224 and the display device 226 may be a single device, such as a touch-screen display.

As shown in FIG. 2, one or more sensors 240 are couple to sensor interface 232. The one or more sensors 240 are configured to sense a level of tension present in the wireline being used in the pump-down operation to control the movements of a tool being positioned within the wellbore, and to provide output signals indicative of the measured tension level in the wireline. Sensor interface 232 is configured to receive the output signals from the one or more sensors 240, in some embodiments to further process these output signals, for example to perform an analog-to-digital conversion of the received sensor signals, and to provide the processed output signals to the processing device 202 and/or to the memory device 208, for example to be stored as sensor data in data 210.

Control module 230 is coupled to winch controller 242 and pump controller 244. Control module 230 is configured to provide output signals to winch controller 242 to control the operation of the winch, which in turn controls the feed rate for the wireline being provided to the wellbore as part of a pump-down operation. In addition, control module 230 is configured to provide output signals to pump controller 244, which in turn controls the fluid flow rate and/or the fluid pressure being provided to the wellbore as part of a pump-down operation. By controlling the feed rate for the wireline and the fluid flow rate/fluid pressure provided to the wellbore, a tool coupled to the wireline may be controllably moved and positioned downhole within the wellbore as part of a pump-down operation. In addition, control module 230 may be configured to receive instructions from the pump-off controller 218 once the pump-off controller has been activated as a result of the predictor 222 predicting a pump-off event to occur at some time in the future. Control module 230 may be configured to provide instructions to the winch controller 242, to the pump controller 244, or both the winch controller and the pump controller, the instructions intended to mediate the operation of these devices in order to avert the actual occurrence of a pump-off event.

In operation, processing device 202 is configured to process the data indicative of the measured tension present on the wireline coupled to winch controller 242 and to a tool being positioned downhole within the wellbore, and in various embodiments using the predictor 222 and a prediction horizon, generate a prediction regarding the tension that will occur on the wireline in the future. The prediction of the tension that will occur on the wireline in the future is compared, for example using processing device 202, to determine if the predicted tension exceeds a predetermined value for a tension threshold, which may be stored as one of values saved in input variables memory 216. In instances where the prediction of the tension that will occur on the wireline in the future does not exceed the predetermined value for a tension threshold, processing device 202 may be configured to continue to provide instructions to control module 230 configured to operate the winch controller and the pump controller in a manner that will continue the pump-down operation being performed on the wellbore.

In instances where the prediction of the tension that will occur on the wireline in the future does exceed the predetermined value for a tension threshold, processing device 202 is configured to activate pump-off control module 218. Pump-off control module 218, when activated, may be configured to provide instructions, which may be executed by processing device 202, to react to the prediction of the pump-off event. In various embodiments, instructions provided to winch controller 242 from pump-off control module 218 may include instructions to speed up the operation of the winch to increase the feed rate of the wireline into the wellbore in order to decrease and/or eliminate tension on the wireline. In various embodiments, instruction provided to pump controller 244 from pump-off control module 218 may include instructions to reduce and/or to stop the pumping of fluid into the wellbore in order to reduce the downhole force being applied by the fluid pressure and the fluid flow rate on the tool that is position within the wellbore, and thus reduce or eliminate the tension on the wireline coupled to the tool.

In various embodiments, processing device 202 may perform operations based on the predictor 222 and the sensor data received from sensors 240 to predict a time-to-pump-off prediction. The predicted time-to-pump-off is compared to a predetermined threshold value for a time-to-pump-off. In instances where the prediction of the predicted time-to-pump-off is greater than the predetermined threshold value for a time-to-pump-off, processing device 202 is configured to continue to provide instructions to control module 230 configured to operate the winch controller and the pump controller in a manner that will continue the pump-down operation being performed on the wellbore. In instances where the predicted time-to-pump-off is less than the predetermined threshold value for a time-to-pump-off, processing device 202 is configured to activate pump-off control module 218. Pump-off control module 218, when activated, may configured to provide instructions, which may be executed by processing device 202, to react to the indication of the pump-off event in any of the same ways as described above, including providing instructions to control module 230 to take over control of the winch controller 242 and/or control of the pump controller 244. In various embodiments, instructions provided to winch controller 242 from pump-off control module 218 may include instructions to speed up the operation of the winch to increase the feed rate of the wireline into the wellbore in order to decrease and/or eliminate tension on the feed line. In various embodiments, instruction provided to pump controller 244 from pump-off control module 218 may include instructions to reduce and/or to stop the pumping of fluid into the wellbore in order to reduce the downhole force being applied by the fluid pressure and the rate of the fluid flow on the tool position within the wellbore, and thus reduce or eliminate the tension on the wireline coupled to the tool.

In various embodiments, computing device 201 may be configured to perform predictions using predictor 222 based both on the prediction horizon and the time-to-pump-off calculation techniques, and to activate the pump-off controller module 218 if either of these calculations result in a scenario where a pump-off event is predicted, in which case the pump-off controller is activated. Various embodiments of a method that may be performed at least in part by computing device 201 utilizing a predictor configured to predict a downhole tension, and activation of a pump-off controller are further illustrated and described below with respect to FIG. 3. Various embodiments of a method that may be performed at least in part by computing device 201 utilizing a predictor configured to predict a time-to-pump-off and activation of a pump-off controller are further illustrated and described below with respect to FIG. 4.

Figure 3:
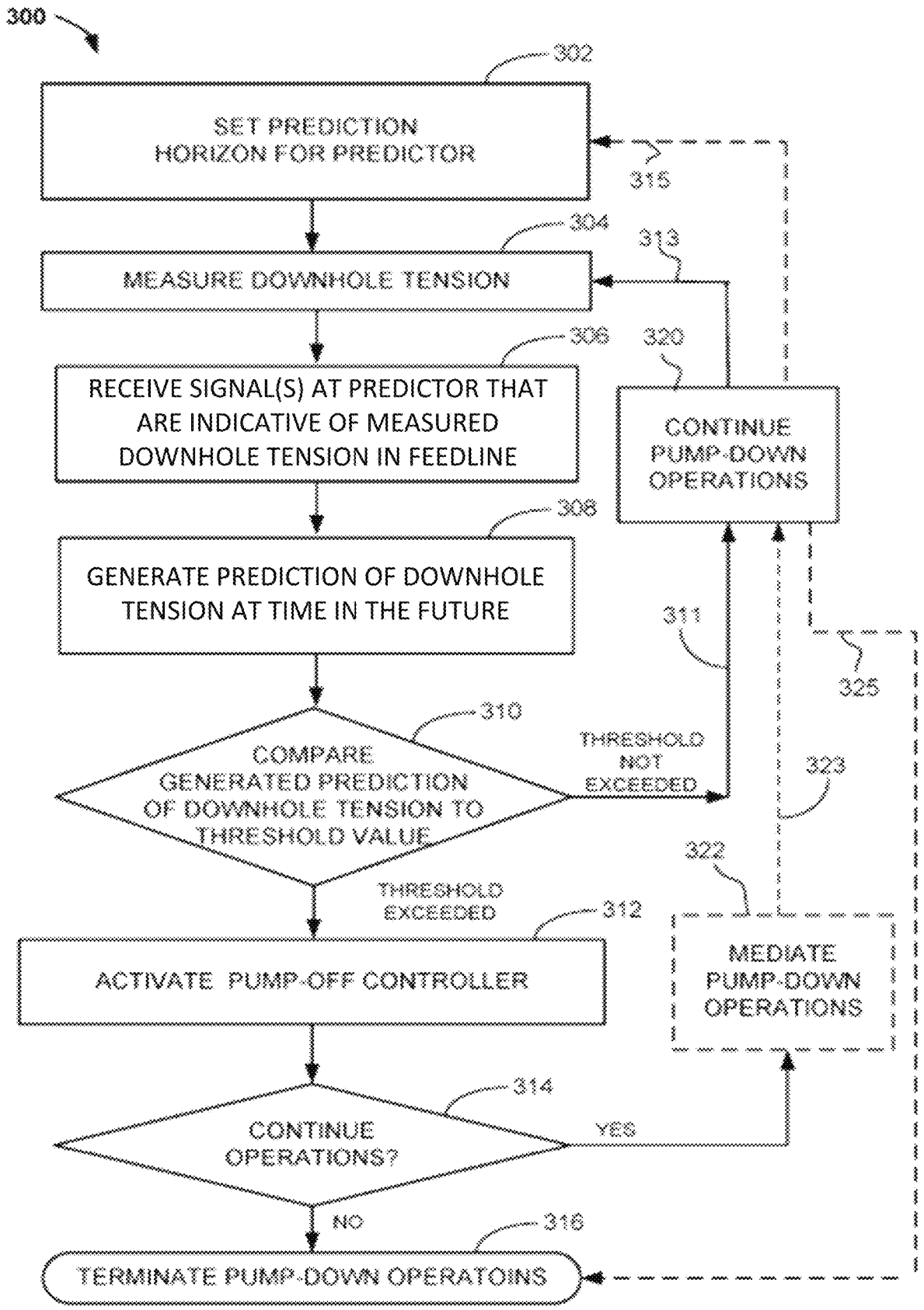
FIG. 3 is a flowchart illustrating a method, according to various embodiments.

FIG. 3 is a flowchart illustrating a method 300 according to various embodiments. The steps of method 300 may be performed by a computing device, such as computing device 201 as illustrated and described above with respect to FIG. 2. In various embodiments, a computing device configured to perform the method steps of method 300 may be included as part of a wellbore system, such as system 100 as illustrated and described above with respect to FIG. 1.

Referring to FIG. 3, embodiments of method 300 include setting a prediction horizon for a predictor (block 302). The prediction horizon may be determined by system specifications and operating parameters including, but are not limited to, maximum acceleration/deceleration rates of the winch or other device controlling feeding of the wireline into the wellbore, maximum acceleration/deacceleration rates for the pump providing the fluid to the wellbore during a pump-down operation, maximum line speed allowed for feeding the wireline into the wellbore, casing size of the wellbore, dimension of the tool and/or weight of the tool being positioned by the pump-down operation, depth of the wellbore, current line speed of the wireline, delay(s) caused by pump/winch controllers, types of the pump-down fluid being used, types of the support line being used, etc. For example, a prediction horizon $t_{prediction}$ can be determined by Equation (1):

$$t_{prediciton}=t_{system}+t_{delay}, \quad (1)$$

in which, $t_{system}$ is the time constant of the system determined from the system specifications, and $t_{delay}$ is the delay time due to the line/fluid propagation and/or delay caused by pump/winch controllers, which is related to the depth of the well, and types of the pump-down fluid, and the support line. In various embodiments, the prediction horizon can be adjusted based on a detection sensitivity factor by as shown in Equation (2):

$$t_{prediciton}=(t_{system}+t_{delay})\cdot f_{sensitivity}, \quad (2)$$

in which, the sensitivity $f_{sensitivity}$ can be determined by operators' input, and/or historical operating data. Typical value for $f_{sensitivity}$ is 1. An $f_{sensitivity}$ settings of less than 1 indicates more conservative detection.

Embodiments of method 300 include measuring downhole tension of a wireline coupled to a tool being lowered into a wellbore as part of a pump-down operation (block 304). Measuring the downhole tension in the wireline may be performed by one or more sensors configured to sense the level of tension in the wireline, and to provide an output signal or output signals that are indicative of the sensed level of tension in the wireline. The sensors are not limited to any particular type of sensor, and may include strain gauges, piezoelectric sensors, hydraulic/pneumatic load cells, or other types of sensor(s) configured to measure the downhole tension in the wireline.

Embodiments of method 300 include receiving signals, for example at a computing device that includes the predictor, the signals indicative of the measure downhole tension in the wireline (block 306). In various embodiments, the computing device may include a sensor interface, such as sensor interface 232 (FIG. 2), configured to receive the output signals being provided from the one or more sensors measuring the downhole tension on the wireline. In various embodiments, the sensor interface may perform signal processing, such as analog-to-digital signal conversion, on the received output signals from the one or more sensors.

Embodiments of method 300 include generating a prediction of downhole tension at a time in the future (block 308). In various embodiments, generating a prediction may include a processing device, such a processing device 202 (FIG. 2) performing operations to execute a set of instructions stored as a predictor, such as predictor 222 (FIG. 2), in order to produce a prediction of downhole tension on the wireline at some time in the future. The timeframe into the future during with the predicted tension is being predicted may be defined by the prediction horizon generated at block 302 of method 300. The prediction of the downhole tension at some time in the future in various embodiments is based solely on the measured tension levels provided as received sensor signals as described at block 306 of method 300.

The prediction of a pump-off event may be based on the prediction of the future downhole tension on the wireline in view of a prediction horizon and a prediction threshold value. The prediction horizon is an indication of how far ahead in time the predictor predicts the future. In various embodiments, the prediction horizon may be determined by the system reaction time, i.e., how fast the pump-down system reacts to a pump-off event. Depending on the prediction horizon, the predictor predicts the future downhole tension out to a time in the future. For a given prediction horizon, the prediction can be made using different methods. The following are details of non-limiting embodiments of prediction methods, as further described below.

In various embodiments, linear transforms can be used for prediction. For example, the predicted tension $T_{predicted}$ can be calculated using Equation (3):

$$T_{predicted}=T_{current}+t_{prediction}\cdot T_{current}, \quad (3)$$

where $T_{current}$ is the measured downhole tension at the current time, and $t_{prediction}$ is the prediction time provided as the prediction horizon. The linear transforms presented in this example are addition, multiplication, and first-order derivative. Other linear transforms, such as high-order derivatives, integrals, subtraction, division, or combinations of them can be used for different types of linear prediction. In some cases, the linear transform can be combined with filters to improve the quality of the prediction. For example, using Equation (4):

$$T_{predicted}=T_{current}+t_{prediction}\cdot LF(\dot{T}_{current}), \quad (4)$$

in which, LF is a low-pass filter that can suppress the noise in the derivative term. The LF may have cutoff frequency in a range from 0.1 Hz to 10 Hz, inclusive.

In various embodiments, non-linear transforms may be used for prediction. Nonlinear transforms include but are not limited to delay, power functions, exponential functions, trigonometric functions, etc. The nonlinear transforms can be used independently or combined with the linear transforms. An example of a nonlinear-transforms-based prediction is provided below as Equation (5):

$$T_{predicted}=T_{current}+t_{prediction}\cdot LF(\dot{T}_{current}). \quad (5)$$

In this example, a linear filter is implemented with the power function. Compared with the linear-transforms-based prediction, the derivative term has a higher weight in the nonlinear prediction.

Embodiments of method 300 include comparing the prediction of the downhole tension at a future time to a threshold value (block 310). The predicted downhole tension will be compared with a predefined threshold value to determine if a pump-off event is predicted for some time within the prediction horizon.

Based on a determination that the prediction of the downhole tension at a future time does not exceed the threshold value ("threshold not exceeded" branch extending from block 310), embodiments of method 300 proceed to block 320, which include continuing the pump-down operations. Continuing the pump-down operations may include determining that the pump-down operation has been completed, for example that the tool has been position at the desired location within the wellbore. In such instances, method 300 may proceed to block 316 (as indicated by dashed line 325), wherein the pump-down operation is terminated. As part of continuing the pump-down operations at block 320, method 300 may include determining that the pump-down operation has not been completed, for example by determining that the tool has not yet reached the desired location within the wellbore. In such instances, method 300 may proceed back to continuing with the pump-down operation, including continuing to measure the downhole tension on the wireline, as indicated by arrow 313. In various embodiments, continuing the pump-down operation may include setting a new prediction horizon for the predictor, as indicated by dashed line 315 coupling block 320 to block 302 in FIG. 3.

Referring again to comparison block 310, if a determination is made that the generated prediction of the downhole tension exceeds the threshold value ("threshold exceeded branch" extending from block 310), embodiments of method 300 may proceed to activate the pump-off controller (block 312). In various embodiments, activation of the pump-off controller may include providing an output signal, for example to a user interface device, indicating that a pump-off event has been predicted. In various embodiments, activation of the pump-off controller includes the pump-off controller taking over control of one or more devices, and/or sending instructions to one or more other devices, to avert the occurrence of a pump-off event. In various embodiments, the pump-off controller will take control over the device, such as the winch, which is controlling the feed rate of the wireline, to speed up the rate that the wireline is being provided to the wellbore in order to reduce and/or eliminate tension on the wireline. In various embodiments, the pump-off controller will take over control of a device, such as the fluid pumping systems that is providing the fluid flow rate/fluid pressure to the wellbore as part of the pump-down operators, in order to reduce and/or eliminate the application of fluid pressure and the fluid flow rate applied to the tool being positioned within the wellbore. In various embodiments, activation of the pump-off controller includes the pump-off controller taking control over both the device(s) controlling the feed rate of the wireline and the device(s) controlling the fluid pumping system.

In various embodiments, once the pump-off controller has controlled the conditions of the pump-down operation in order to avert a pump-off event, embodiments of method 300 may proceed to a decision of whether or not to continue the pump-down operations (block 314). In various embodiments, the decision as to whether or not to continue the pump-down operations may be based on a user input provided to the system, for example an input provided by a field technician or an engineer. If a decision is made not to continue the pump-down operations ("NO" branch extending from block 314), method 300 proceeds to terminate the pump-down operations (block 316). If a decision is made to continue the pump-down operations ("YES" branch extending from block 314), method 300 may continue pump-down operations at block 320. In various embodiments, the continuation of the pump-down operations in method 300 may include mediating the pump-down operation (block 322), by taking over control of the winch and/or the pumping system, and/or reconfiguring the operational parameters of the winch, such as the desired wireline speed of the winch, and/or the operational parameters of the pump, such resetting the pump pressure(s) and/or flow rates. Once the mediation activities at block 322 have been completed, embodiments of method 300 may return to the continuation of the pump-down operation, as indicated by dashed line 323 extending from block 322 to block 320. Once returned to block 320, method 300 may perform any of the subsequent steps from block 320 as described above.

Figure 4:
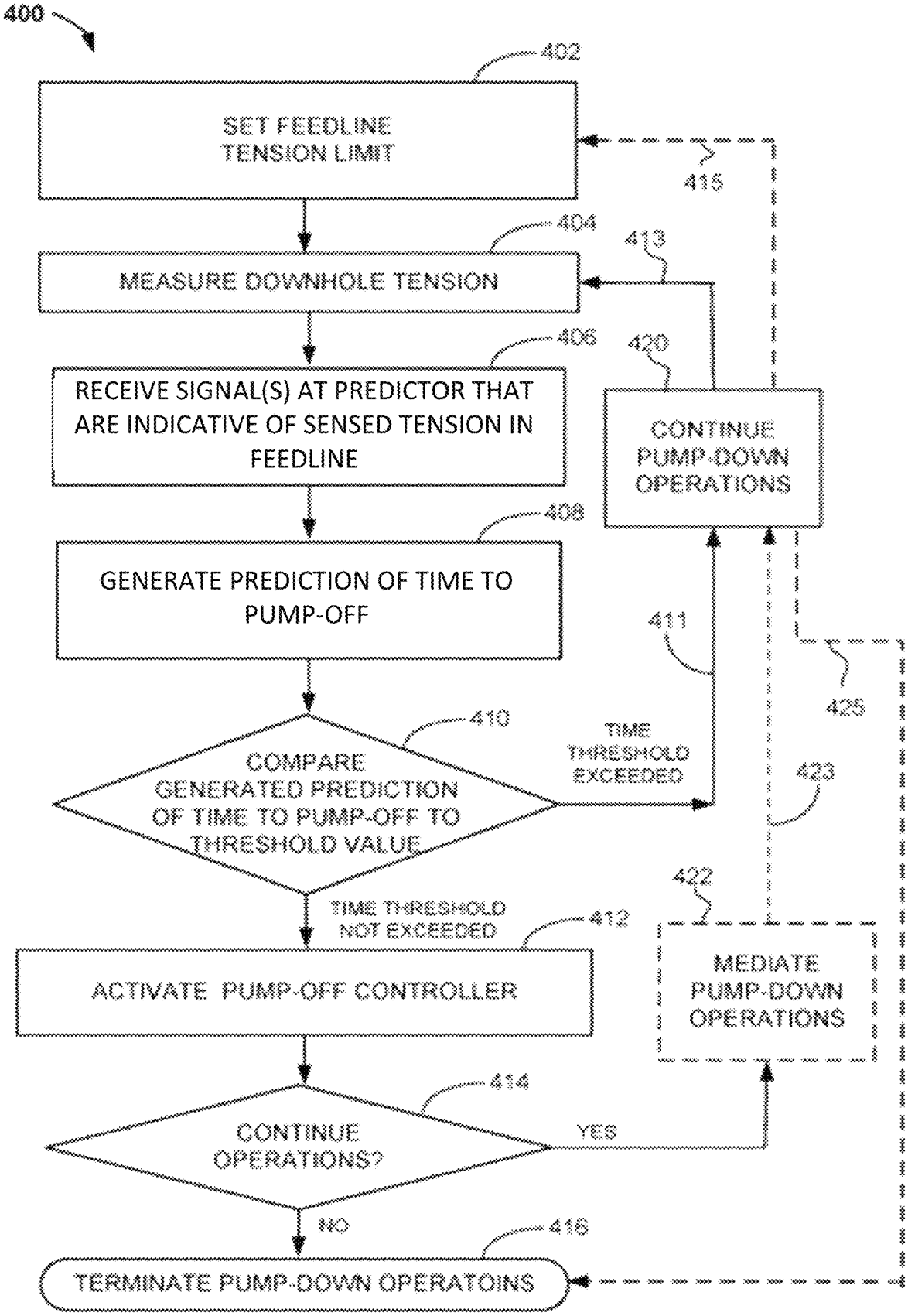
FIG. 4 is a flowchart illustrating an alternative method, according to various embodiments.

FIG. 4 is a flowchart illustrating an alternative method 400, according to various embodiments. Various aspects of method 400 are the same as or similar to corresponding steps described above with respect to method 300 and FIG. 3. Therefore, for the sake of compactness the descriptions for various steps included in method 400 may refer to the corresponding step(s) as described for method 300, and may include the entirety of the scope attributable to the referred to step(s) of method 300.

Referring back to FIG. 4, embodiments of method 400 include setting a downhole tension limit (block 402). The downhole tension limit may be a value for the downhole tension that is not to be exceeded as part of a normal pump-down process, and is related to the mechanical specifications for the feedline. In various embodiments, if the downhole tension limit were to be exceeded in an actual pump-down operation, a pump-off event may occur. In various embodiments, a typical range for the value of the downhole tension limit is a value in a range of 2000 to 5000 pound-force (lbf), inclusive.

Embodiments of method 400 include measuring a downhole tension of a wireline coupled to a tool being lowered into a wellbore as part of a pump-down operation (block 404). Embodiments of measuring a tension of the wireline may include any of the operations and/or parameters as described in this disclosure, including as described above with respect to block 304 of method 300.

Referring to FIG. 4, embodiments of method 400 include receiving signals, for example at a computing device that includes a predictor, the signals indicative of the measured downhole tension in the wireline (block 406). Receiving the sensor signals may include any of the operations and/or parameters as described throughout this disclosure, including as described above with respect to block 306 of method 300.

Referring again to FIG. 4, embodiments of method 400 include generating a prediction of a time-to-pump-off (TTP). In various embodiments, generating a prediction may include a processing device, such a processing device 202 (FIG. 2) performing operations to execute instructions stored as a predictor, such as predictor 222 (FIG. 2), in order to produce a prediction of a time in the future when a pump-off will occur. The prediction of a time-to-pump-off is a prediction of the amount of time, for example in seconds, until the tension of the wireline will reach the downhole tension limit set at block 402.

Embodiments of method 400 may utilizing any of the techniques described above with respect to predictions in block 308 of method 300, including linear-transform based methods, and non-linear transform based models. An example of calculating a value for TTP using a linear-transform-based model is provided below as Equation (6):

$$TTP=(T_{limit}-T_{current})/\dot{T}_{current} \quad (6)$$

where $T_{limit}$ is the limit of the downhole tension and $T_{current}$ is the current tension in the wireline. There are also alternative methods to predict the downhole tension or the time-to-pump-off (TTP). Details are as follows. In various embodiments, Artificial Neural Networks can be used for prediction. The training of the ANNs can be online or offline. The training datasets can be obtained from historical pump-down operations (offline training) and/or the target well operations (online training). In various embodiments, machine learning models such as support vector machine, decision trees, etc., may be used for the prediction. The training datasets can be obtained from historical pump-down operations (offline training) and/or the target well operations (online training). In various embodiments, statistical models such as AutoRegressive Model (AR), Moving Average Model (MA), AutoRegressive Moving Average Model (ARMA), and AutoRegressive Integrated Moving Average Model (ARIMA), etc., can be used in the prediction. The order and parameters of the model can be estimated from historical pump-down operations (offline estimation) and/or the target well operations (online estimation).

Embodiments of method 400 include comparing the generated prediction of time-to-pump-off to a TTP threshold value (block 410). In various embodiments, the TTP threshold value is set based on a reaction time of the system, for example based on how fast the system can react to a pump-off. Based on a determination that the generated prediction of time-to-pump-off does exceed the TTP threshold value, ("time threshold exceeded" branch extending from block 410), embodiments of method 400 proceed to block 420, which includes continuing the pump-down operations. Continuing the pump-down operations may include determining that the pump-down operation has been completed, for example that the tool has been position at the desired location within the wellbore. In such instances, method 400 may proceed to block 416 (as indicated by dashed line 425), wherein the pump-down operation is terminated. As part of continuing the pump-down operations at block 420, method 400 may include determining that the pump-down operation has not been completed, for example by determining that the tool has not yet reached the desired location within the wellbore. In such instances, method 400 may proceed back to continuing with the pump-down operation, including continuing to measure the downhole tension on the wireline, as indicated by line 413. In various embodiments, continuing the pump-down operation may include setting a value for the downhole tension limit, as indicated by dashed line 415 coupling block 420 to block 402 in FIG. 4.

Referring again to comparison block 410, if a determination is made that the generated prediction of time-to-pump-off does not exceed the TTP threshold value ("time threshold not exceeded" branch extending from block 410), embodiments of method 400 may proceed to activate the pump-off controller (block 412). In various embodiments, activation of the pump-off controller may include providing an output signal, for example to a user interface device, indicating that a pump-off event has been predicted. In various embodiments, activation of the pump-off controller includes the pump-off controller taking over control of one or more devices, and/or sending instructions to one or more other devices, to avert the occurrence of a pump-off event. In various embodiments, the pump-off controller will take control over the device, such as the winch, which is controlling the feed rate of the wireline, and speed up the rate at which the wireline is being provided to the wellbore in order to reduce and/or eliminate tension on the wireline. In various embodiments, the pump-off controller will take over control of a device, such as the fluid pumping systems that is providing the fluid flow rate/fluid pressure to the wellbore as part of the pump-down operators, in order to reduce and/or eliminate the application of fluid pressure and/or the rate flow of fluid to the tool being positioned within the wellbore. In various embodiments, activation of the pump-off controller includes the pump-off controller taking over control of both devices controlling the controlling the feed rate of the wireline and devices controlling the fluid pumping system that is providing the fluid flow rate/fluid pressure to the wellbore.

In various embodiments, once the pump-off controller has controlled the conditions of the pump-down operation in order to avert a pump-off event, embodiments of method 400 may proceed to decision of whether or not to continue the pump-down operations (block 414). In various embodiments, the decision as to whether or not to continue the pump-down operations may be based on a user input provided to the system, for example an input provided by a field technician or an engineer. If a decision is made not to continue the pump-down operations ("NO" branch extending from block 414), method 400 proceeds to terminate the pump-down operations (block 416). If a decision is made to continue the pump-down operations ("YES" branch extending from block 414), method 400 may continue pump-down operations at block 420. In various embodiments, the continuation of the pump-down operation in method 400 may include mediating the pump-down operation (block 422) by taking over control of the winch and/or pumping systems, and/or reconfiguring the operational parameters of the winch, such as the desired wireline speed of the winch, and/or operational parameters of the pump, such resetting the pump pressure(s) and/or flow rates. Once the mediation activities at block 422 have been completed, embodiment of method 400 may return to the continuation of the pump-down operations, as indicated by dashed line 423 extending from block 422 to block 420, while allowing the continuation of the pump-down operations to proceed at block 420. Once returned to block 420, method 400 may perform any of the subsequent steps available from block 420 as described above.

Figure 5:
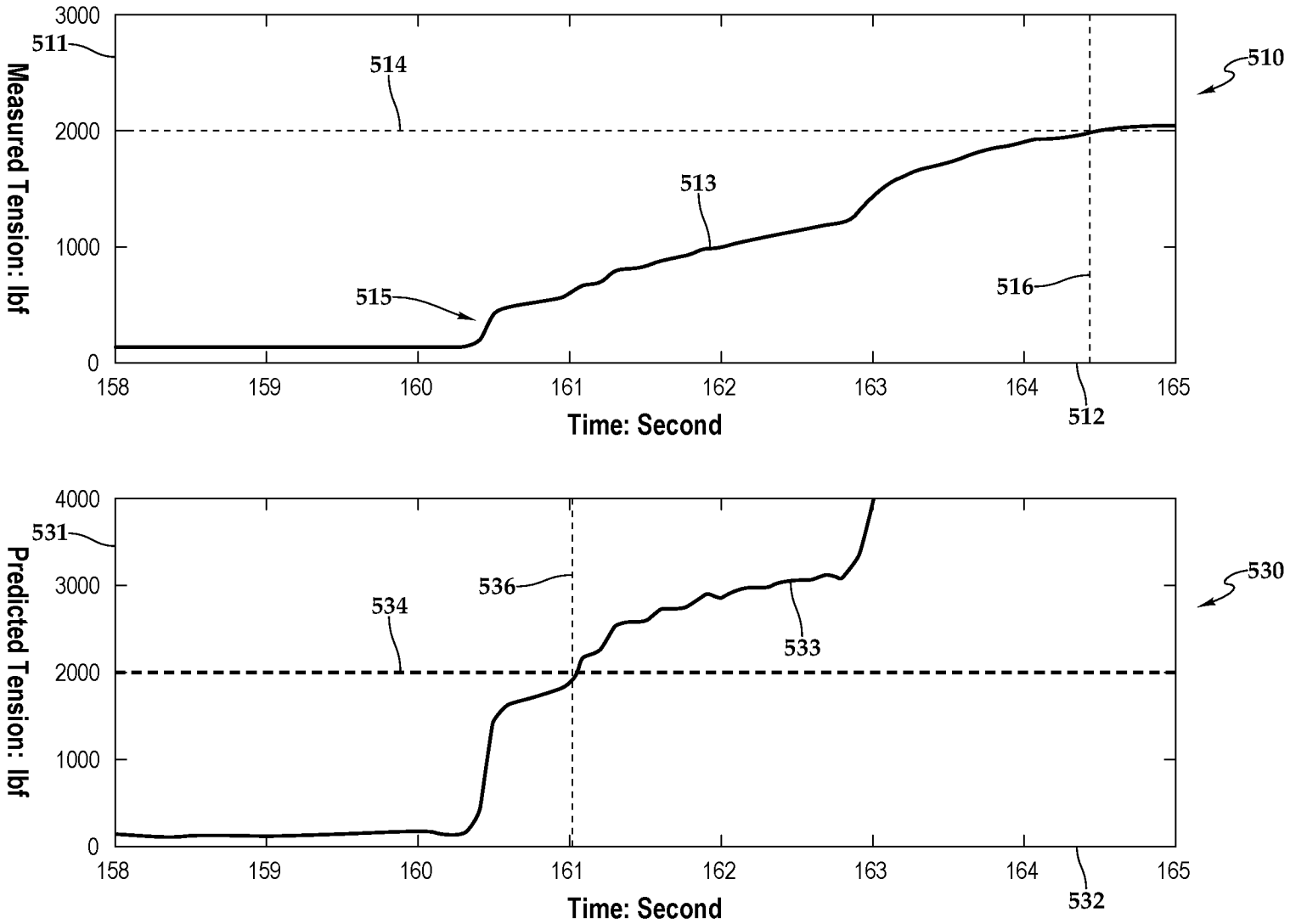
FIG. 5 illustrates a pair of graphs showing a comparison of actual measured tension on a wireline to a predicted tension output for the wireline during a pump-down operation, according to various embodiments.

FIG. 5 illustrates a pair of graphs 510, 530, showing a comparison of actual measured tension on a wireline to a predicted tension output for the wireline during a pump-down operation. Graph 510 includes a vertical axis 511 representing a measured tension in pound-force for a wireline being used to convey a tool into a wellbore, and a horizontal axis 512 representing time in seconds. Graphical line 513 represents the measured tension of the wireline over the time interval between 158 and 165 seconds, or seven seconds in total. Horizontal dashed line 514 represent a threshold tension level set at 2000 pound-force. Vertical dashed line 516 represents the time between 164 and 165 seconds wherein the measured tension reached the threshold tension level indicated by horizontal dashed line 514. In the example setup used to generate this data depicted in graphs 510 and 530, a linear-transform-based predictor was used, and a threshold value for the predicted tension of the wireline is set to 2000 pounds based on the strength of the support line.

Graph 530 includes a vertical axis 531 representing a predicted tension in pound-force for the same wireline used to convey a tool into a wellbore as depicted in graph 510. Graph 530 further includes a horizontal axis 532, representing time in seconds. Horizontal axis 532 of graph 530 represents the same time interval represented by horizontal axis 512 of graph 510, and wherein graph 530 is positioned in a left-right position so that corresponding times represented in graph 510 align vertically in FIG. 5 with the corresponding same times in graph 530. In graph 530, graphical line 533 represents the predicted tension of the wireline over the time interval between 158 and 165 seconds, or seven seconds in total. In graph 530, horizontal dashed line 534 represent a threshold tension level set at 2000 pound-force, and vertical dashed line 536 represents the time at about 161 seconds when the predicted tension reached the threshold tension level indicated by horizontal dashed line 534.

Figure 6:
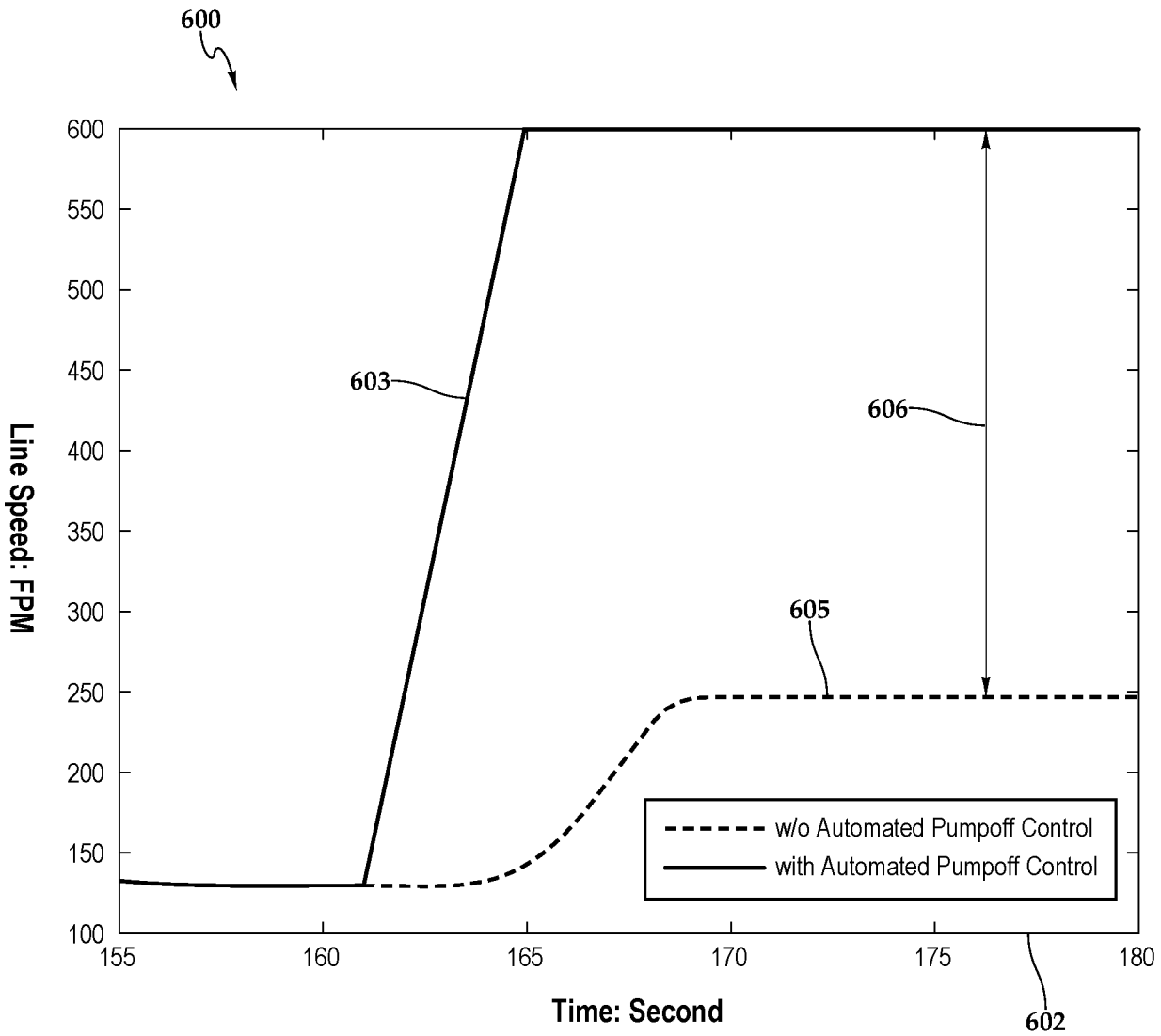
FIG. 6 illustrates a graph comparing the change in the line speed of a wireline using pump-off prediction compared to the change in the line speed without pump-off prediction, according to various embodiments.

FIG. 6 illustrates a graph 600 comparing the change in the line speed of a wireline using pump-off detection compared to the change in the line speed without pump-off detection, according to various embodiments. Graph 600 includes a vertical axis 601 representing a line speed for a wireline being utilized in a pump-down operation, in feet per minute (FPM), and a horizontal axis 602 representing time in seconds. The solid line 603 represents line speed of the wireline in FPM over time when the pump-off controller activation is utilized. The dashed line 605 represents line speed of the wireline in FPM over time without the use of the pump-off controller activation. In the example setup used to generate this data depicted in graph 600, a linear-transform-based predictor was used, and a threshold value for the predicted tension of the wireline is set to 2000 pounds based on the strength of the support line.

In graph 600 the pump-off starts at the 160.3 second mark in time. When utilizing pump-off controller activation, the pump-off event is detected at the 161 second mark in time. The prediction at the 161 second mark is for tension after $t_{prediction}$ seconds. When the pump-off is detected, the pump-off controller is activated. As shown by graph 600 and solid graphical line 603, once the pump-off is detected, the line speed of the wireline increased from less than 150 feet/minute (FPM) to 600 FPM at around the 164 mark in time. Without the pump-off controller being activated, as shown by dashed line 605 the line speed of the wireline increased from below the 150 FPM mark at the time of the pump-off to only about 230 FPM, and takes until approximately the 168 second mark to climb to the 230 FPM line speed. As indicated by arrow 606, the difference in the increase in the line speed of the wireline at any given time past the point of the pump-off activation is over 350 FPM. The quicker reaction to the increase in the line speed of the wireline, and the overall larger amount of the increase in the line speed of the wireline using the pump-off controller activation, shows how the use of the pump-off controller activation may be used to avert an actual pump-off event from occurring compared to pump-down operations being performed without the pump-off prediction being utilized by providing a more rapid and larger increase in the line speed of the wireline.

Figure 7:
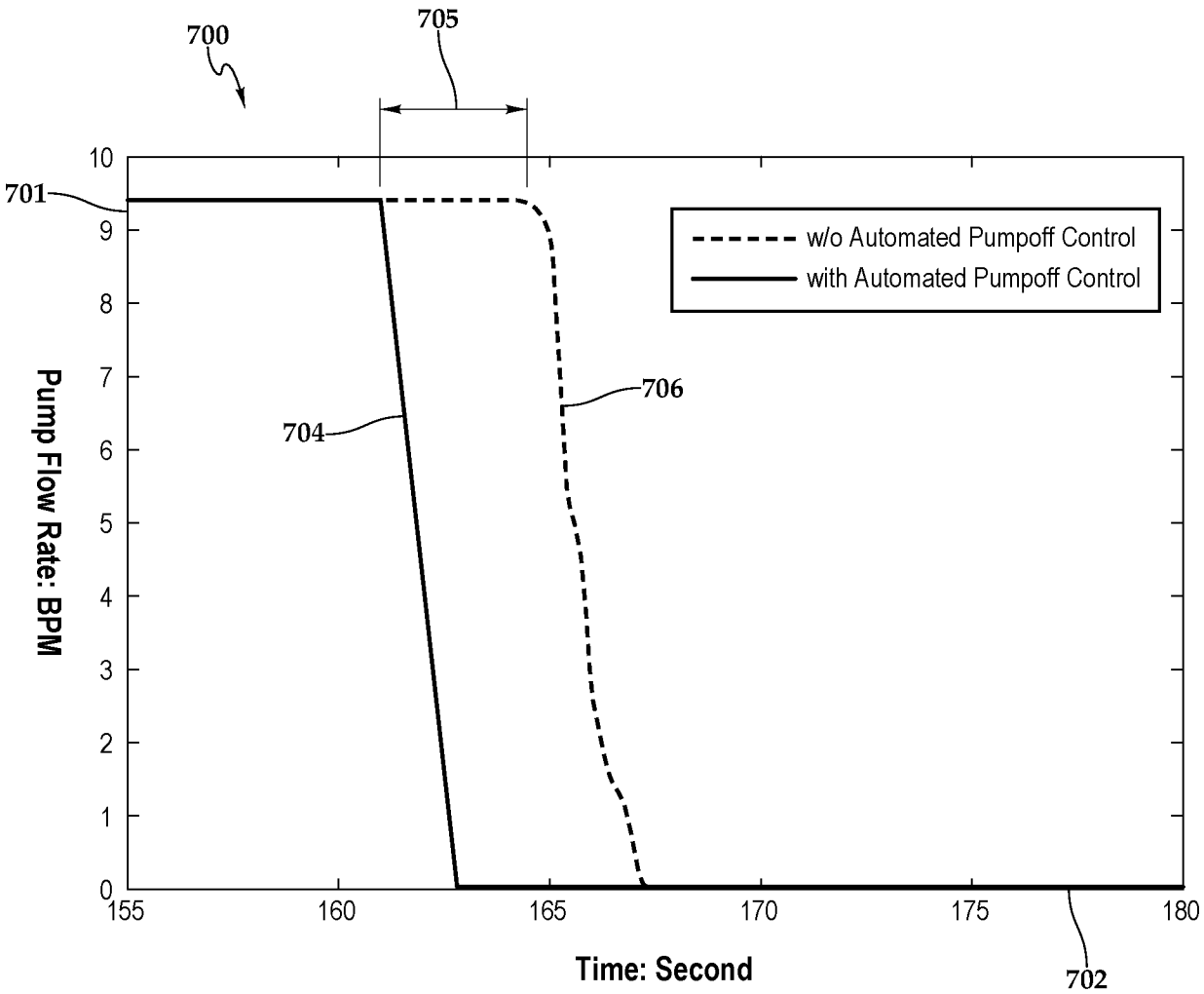
FIG. 7 illustrates a graph comparing the change in the pump flow rate present during a pump-down operation using pump-off prediction and pump-off controller activation compared to the change in the pump flow rate during a pump-down operation without pump-off prediction and pump-off controller activation, according to various embodiments.

FIG. 7 illustrates a graph 700 comparing the change in the pump flow rate present during a pump-down operation using pump-off controller activation compared to the change in the pump flow rate during a pump-down operation without pump-off controller activation, according to various embodiments. Graph 700 includes a vertical axis 701 representing a pump flow rate in barrels-per-minute (BPM) being utilized in a pump-down operation, and a horizontal axis 702 representing time in seconds. The solid line 704 represents pump flow rate in BPM over time when the pump-off controller activation is utilized. The dashed line 706 represents pump flow rate in BPM over time without the use of pump-off controller activation.

In graph 700 the pump-off starts at the 160.3 second mark in time. When utilizing pump-off controller activation, the pump-off event is detected at the 161 second mark in time. The prediction at the 161 second mark is for tension after $t_{prediction}$ seconds. When the pump-off is detected, the pump-off controller is activated. As shown by graph 700 and solid graphical line 704, once the pump-off is detected, the pump flow rate decreases from over 9 BPM to 0 BPM by approximately the 163 time mark. In comparison, the pump-off controller activation, as shown by dashed line 706 the decrease in the pump flow rate does not begin until almost the 165 second mark, and decreased to 0 BPM at around the 166.5 second mark. As such, there is approximately a 3 second delay in starting to decrease the pump flow rate when performing a pump-down operation without the use of the pump-off controller activation compared to the initiation of the decrease in the pump flow rate when using pump-off controller activation. The quicker reaction time to the start of the decrease in the pump flow rate using pump-off controller activation shows how the pump-off controller activation may be used to avert an actual pump-off event from occurring compared to pump-down operations being performed without the pump-off controller activation.

The flowcharts provided as part of this disclosure are intended to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more non-transitory machine-readable media. Accordingly, aspects may take the form of hardware, software (including firmware, resident software, microcode, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, which employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device. Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and/or accepting input on another machine. The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for automatically predicting a pump-off event may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure. Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example embodiments include the following.

Embodiment 1. A method comprising: receiving signals corresponding to sensed measurements of a tension in a wireline coupled to a tool while the tool is being positioned within a wellbore as part of a pump-down procedure; determining, based solely on the downhole tension measured for the wireline, a prediction for a downhole tension for the wireline at some future time; comparing the prediction for the downhole tension to a predetermined tension threshold value; and predicting a pump-off event based on a value for the prediction for the downhole tension exceeding the predetermined tension threshold value.

Embodiment 2. The method of embodiment 1, wherein the prediction for the downhole tension for the wireline at some future time is determined using a linear transform.

Embodiment 3. The method of embodiment 1, wherein the prediction for the downhole tension for the wireline at some future time is determined using a non-linear transform.

Embodiment 4. The method of any one of embodiments 1-3, wherein determining the prediction for a downhole tension for the wireline at some future time includes setting a prediction horizon indicative of how far ahead in time the downhole tension is to be predicted.

Embodiment 5. The method of embodiment 4, further comprising adjusting the prediction horizon based on a detection sensitivity factor.

Embodiment 6. The method of embodiments 4 or 5, wherein the prediction horizon is determined, at least in part, based on a reaction time of one or more components of a system performing the pump-down procedure.

Embodiment 7. The method of any one of embodiments 1-6, further comprising: taking control of the pump-down procedure, using a pump-off controller, when a pump-off event has been predicted.

Embodiment 8. The method of embodiment 7, wherein taking control of the pump-down procedure includes shutting down one or more pumps providing fluid pressure, the fluid pressure provided to the wellbore at a controlled fluid flow rate to move the tool in a downhole direction within the wellbore as part of the pump-down procedure.

Embodiment 9. The method of embodiments 7 or 8, wherein taking control of the pump-down procedure includes increasing a line speed at which the wireline is being extended into the wellbore.

Embodiment 10. The method of any one of embodiments 1-3 or 9, further comprising: determining a prediction of an amount of time during the pump-down procedure until the tension in the wireline reaches the predetermined tension threshold value; comparing the prediction of the amount of time until the tension in the wireline reaches the predetermined tension threshold value to a time-to-pump-off threshold value; and predicting a pump-off event based on a determination that amount of time until the tension in the wireline reaches the predetermined tension threshold value is less than the time-to-pump-off threshold value.

Embodiment 11. The method of any one of embodiments 1-10, wherein measuring the tension in a wireline coupled to the tool comprises sensing the tension in the wireline using a sensor located within the wellbore.

Embodiment 12. The method of any one of embodiments 1-11, further comprising: mediating the pump-down procedure when the pump-off event has been predicted and following activation of a pump-off controller, wherein mediating the pump-down procedure includes reconfiguring at least one operational parameter related to a wireline apparatus controlling the line speed at which the wireline is being extended into the wellbore, and/or reconfiguring at least one operational parameter related to one or more pumps providing fluid pressure at a controlled fluid flow rate to the wellbore to move the tool in the downhole direction within the wellbore; and continuing with the pump-down operation utilizing the at least one reconfigured operational parameter for the wireline apparatus and/or the at least one reconfigured operational parameter for the one or more pumps.

Embodiment 13. A system comprising: a computing device including a processor, the computing device configured to: receive signals corresponding to sensed measurements of a tension in a wireline coupled to a tool while the tool is being positioned within a wellbore as part of a pump-down procedure; determine, by the processor and based solely on the tension measured for the wireline, a prediction for a downhole tension for the wireline at some future time; compare, by the processor, the prediction for the downhole tension to a predetermined tension threshold value; and predict, by the processor, a pump-off event based on a value for the prediction for the downhole tension exceeding the predetermined tension threshold value.

Embodiment 14. The system of embodiment 13, wherein the computing device is further configured to: determine, by the processor, the prediction for the downhole tension for the wireline at some future time using a prediction horizon indicative of how far ahead in time the downhole tension is to be predicted.

Embodiment 15. The system of embodiment 14, further comprising adjusting, by the processor, the prediction horizon based on a detection sensitivity factor.

Embodiment 16. The system of any one of embodiments 13-15, wherein the computing device is further configured to activate a pump-off controller when a pump-off event has been predicted.

Embodiment 17. The system of embodiment 16, wherein the pump-off controller is configured to shut down one or more pumps providing a fluid pressure to the wellbore at a controlled fluid flow rate, the fluid flow rate configured to move the tool in a downhole direction within the wellbore as part of the pump-down procedure.

Embodiment 18. The system of embodiments 16 or 17, wherein the pump-off controller is configured to operate a wireline device configured to provide the wireline to the wellbore at an increased feed speed to reduce the tension on the wireline.

Embodiment 19. The system of any one of embodiments 13-15, wherein the computing device is further configured to: determine, by the processor, a prediction of an amount of time during the pump-down procedure until the tension in the wireline reaches the predetermined tension threshold value; compare, by the processor, the prediction of the amount of time until the tension in the wireline reaches the predetermined tension threshold value to a time-to-pump-off threshold value; and predict, by the processor, the pump-off event based on a determination that amount of time until the tension in the wireline reaches the predetermined tension threshold value is less than the time-to-pump-off threshold value.

Embodiment 20. The system of any one of embodiments 13-19, wherein the computing device is further configured to: mediate the pump-down procedure when the pump-off event has been predicted and following activation of a pump-off controller, wherein mediating the pump-down procedure includes reconfiguring at least one operational parameter related to a wireline apparatus controlling the line speed at which the wireline is being extended into the wellbore and/or reconfiguring at least one operational parameter related to one or more pumps providing fluid pressure at a controlled fluid flow rate to the wellbore to move the tool in the downhole direction within the wellbore, and continuing with the pump-down operation utilizing the at least one reconfigured operational parameter for the wireline apparatus and/or the at least one reconfigured operational parameter for the one or more pumps.

Embodiment 21. An apparatus comprising: a processor; and a non-transitory machine-readable medium having program code executable by the processor to cause the apparatus to: receive signals corresponding to sensed measurements of a tension in a wireline coupled to a tool while the tool is being positioned within a wellbore as part of a pump-down procedure; determine, based solely on the tension measured for the wireline, a prediction for a downhole tension for the wireline at some future time; compare the prediction for the downhole tension to a predetermined tension threshold value; and predict a pump-off event based on a value for the prediction for the downhole tension exceeding the predetermined tension threshold value.

Embodiment 22. The apparatus of embodiment 21, wherein the program code executable by the processor is further configured to cause the apparatus to: determine a prediction of an amount of time during the pump-down procedure until the tension in the wireline reaches the predetermined tension threshold value; compare the prediction of the amount of time until the tension in the wireline reaches the predetermined tension threshold value to a time-to-pump-off threshold value; and predict the pump-off event based on a determination that amount of time until the tension in the wireline reaches the predetermined tension threshold value is less than the time-to-pump-off threshold value.

What is claimed is:

1. A method comprising:

receiving signals corresponding to sensed measurements of a tension in a wireline coupled to a tool while the tool is being positioned within a wellbore as part of a pump-down procedure;

determining a system reaction time for reacting to a pump-off event during the pump-down procedure;

determining a prediction horizon, the prediction horizon based, at least in part, on the system reaction time;

determining, based on the tension measured for the wireline, a prediction for a downhole tension for the wireline at the prediction horizon;

comparing the prediction for the downhole tension at the prediction horizon to a predetermined tension threshold value;

predicting a pump-off event based on a value for the prediction for the downhole tension at the prediction horizon exceeding the predetermined tension threshold value;

activating a pump-off controller; and mediating the pump-down procedure upon predicting the pump-off event, wherein mediating the pump-down procedure includes reconfiguring at least one of an operational parameter related to a wireline apparatus controlling a line speed at which the wireline is being extended into the wellbore, and an operational parameter related to one or more pumps providing fluid pressure at a controlled fluid flow rate to the wellbore to move the tool in a downhole direction within the wellbore.

2. The method of claim 1, wherein the prediction for the downhole tension for the wireline at the prediction horizon is determined using a linear transform.

3. The method of claim 1, wherein the prediction for the downhole tension for the wireline at the prediction horizon is determined using a non-linear transform.

4. The method of claim 1, wherein the prediction horizon is based on a system time $t_{system}$ and a system delay $t_{delay}$.

5. The method of claim 4, further comprising adjusting the prediction horizon based on a detection sensitivity factor.

6. The method of claim 1 wherein the system reaction time is determined, at least in part, based on a reaction time of one or more components of a system performing the pump-down procedure.

7. The method of claim 1 further comprising:

taking control of the pump-down procedure, using the pump-off controller, when the pump-off event has been predicted.

8. The method of claim 7, wherein taking control of the pump-down procedure includes shutting down one or more pumps providing fluid pressure, the fluid pressure provided to the wellbore at a controlled fluid flow rate to move the tool in a downhole direction within the wellbore as part of the pump-down procedure.

9. The method of claim 7, wherein taking control of the pump-down procedure includes increasing a line speed at which the wireline is being extended into the wellbore.

10. The method of claim 1, wherein predicting a pump-off event includes determining a wireline tension associated with the pump-off event and setting the wireline tension associated with the pump-off event as the predetermined tension threshold value.

11. The method of claim 1, wherein measuring the tension in a wireline coupled to the tool comprises sensing the tension in the wireline using a sensor located within the wellbore.

12. The method of claim 1, further comprising:

modifying one or more operational parameters to reduce likelihood of pump-off, the operational parameters including a wireline line speed and a fluid flow rate within the borehole.

13. A system comprising:

a wireline coupled to a tool to be positioned within a wellbore;

a computing device including a processor, the computing device configured to:

receive signals corresponding to sensed measurements of a tension in the wireline while the tool is being positioned within the wellbore as part of a pump-down procedure;

determine a system reaction time for reacting to a pump-off event during the pump-down procedure;

determine a prediction horizon, the prediction horizon based, at least in part, on the system reaction time;

determine, by the processor and based on the tension measured for the wireline, a prediction for a downhole tension for the wireline at the prediction horizon;

compare, by the processor, the prediction for the downhole tension at the prediction horizon to a predetermined tension threshold value;

predict, by the processor, a pump-off event based on a value for the prediction for the downhole tension at the prediction horizon exceeding the predetermined tension threshold value;

activate a pump-off controller; and mediate the pump-down procedure upon predicting the pump-off event, wherein mediating the pump-down procedure includes reconfiguring at least one of an operational parameter related to a wireline apparatus controlling a line speed at which the wireline is being extended into the wellbore and an operational parameter related to one or more pumps providing fluid pressure at a controlled fluid flow rate to the wellbore to move the tool in a downhole direction within the wellbore.

14. The system of claim 13, wherein the computing device is further configured to:

determine, by the processor, the prediction horizon, the prediction horizon based on a system time $t_{system}$ and a system delay $t_{delay}$.

15. The system of claim 14, further comprising adjusting, by the processor, the prediction horizon based on a detection sensitivity factor.

16. The system of claim 13, wherein the system further comprises a pump-off controller, the pump-off controller configured to reduce a fluid pressure provided by one or more pumps, the one or more pumps providing a fluid pressure to the wellbore at a controlled fluid flow rate, the fluid flow rate configured to move the tool in a downhole direction within the wellbore as part of the pump-down procedure.

17. The system of claim 13, wherein the system further comprises a pump-off controller, the pump-off controller configured to operate a wireline device configured to provide the wireline to the wellbore at an increased feed speed to reduce the tension on the wireline.

18. The system of claim 13, wherein the computing device is further configured to determine, by the processor, a wireline tension associated with the pump-off event and to set the wireline tension associated with the pump-off event as the predetermined tension threshold value.

19. The system of claim 13, wherein the computing device is further configured to:

modify one or more operational parameters to reduce likelihood of pump-off, the operational parameters including a wireline line speed and a fluid flow rate within the borehole.

20. An apparatus comprising:

a processor; and a non-transitory machine-readable medium having program code executable by the processor to cause the apparatus to:

receive signals corresponding to sensed measurements of a tension in a wireline coupled to a tool while the tool is being positioned within a wellbore as part of a pump-down procedure;

determine a system reaction time for reacting to a pump-off event during the pump-down procedure;

determine a prediction horizon, the prediction horizon based, at least in part, on the system reaction time;

determine, based on the tension measured for the wireline, a prediction for a downhole tension for the wireline at the prediction horizon;

comparing the prediction for the downhole tension at the prediction horizon to a predetermined tension threshold value;

predict a pump-off event based on a value for the prediction for the downhole tension at the prediction horizon exceeding the predetermined tension threshold value;

activate a pump-off controller; and mediate the pump-down procedure upon predicting the pump-off event and activating the pump-off controller, wherein mediating the pump-down procedure includes reconfiguring at least one of an operational parameter related to a wireline apparatus controlling a line speed at which the wireline is being extended into the wellbore and an operational parameter related to one or more pumps providing fluid pressure at a controlled fluid flow rate to the wellbore to move the tool in a downhole direction within the wellbore.

21. The apparatus of claim 20, wherein the program code executable by the processor is further configured to cause the apparatus to:

determine a wireline tension associated with the pump-off event and to set the wireline tension associated with the pump-off event as the predetermined tension threshold value.

* * * * *